US008998564B2

(12) United States Patent
Lemmers, Jr. et al.

(10) Patent No.: US 8,998,564 B2
(45) Date of Patent: Apr. 7, 2015

(54) MOTOR-GENERATOR CONNECTION SHAFT VENT

(75) Inventors: Glenn C. Lemmers, Jr., Loves Park, IL (US); David S. Behling, Belvidere, IL (US); Luke Wagner, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1058 days.

(21) Appl. No.: 13/047,950

(22) Filed: Mar. 15, 2011

(65) Prior Publication Data

US 2012/0237337 A1 Sep. 20, 2012

(51) Int. Cl.
*F01D 15/10* (2006.01)
*F01D 5/02* (2006.01)

(52) U.S. Cl.
CPC ..... *F01D 5/026* (2013.01); *F01D 15/10* (2013.01); *F05D 2260/608* (2013.01)

(58) Field of Classification Search
USPC ..... 415/116, 117, 107, 121.3; 60/788, 802
See application file for complete search history.

(56) References Cited

U.S. PATENT DOCUMENTS

| | | | | |
|---|---|---|---|---|
| 3,835,722 | A | 9/1974 | Bertram et al. | |
| 4,269,293 | A | 5/1981 | Martin | |
| 4,588,322 | A | 5/1986 | Shoemaker et al. | |
| 4,685,550 | A | 8/1987 | Metcalf | |
| 5,103,949 | A | 4/1992 | Vanderzyden et al. | |
| 5,174,109 | A | 12/1992 | Lampe | |
| 5,901,013 | A | 5/1999 | Lee et al. | |
| 6,725,643 | B1 | 4/2004 | Paul | |
| 6,732,529 | B2 | 5/2004 | Anderson | |
| 7,182,193 | B2 | 2/2007 | Howard | |
| 8,568,089 | B2 * | 10/2013 | Lemmers et al. | 415/122.1 |
| 2009/0224728 | A1 * | 9/2009 | Burke et al. | 322/41 |

* cited by examiner

*Primary Examiner* — Edward Look
*Assistant Examiner* — Maxime Adjagbe
(74) *Attorney, Agent, or Firm* — Carlson, Gaskey & Olds, P.C.

(57) ABSTRACT

An example method of reducing loads on a connection shaft includes disengaging a connection shaft from a motor-generator such that the connection shaft is not rotatably coupled to the motor-generator. The method communicates a fluid away from the motor-generator through a communication path established within the connection shaft. An example turbomachine connection shaft is configured to selectively rotatably couple a turbomachine rotor and a motor-generator. The connection shaft establishes a communication path that selectively vents the motor-generator.

20 Claims, 3 Drawing Sheets

MOTOR-GENERATOR CONNECTION SHAFT VENT

BACKGROUND

This disclosure relates generally to a connection shaft for a motor-generator and, more particularly, to venting the motor-generator through the connection shaft.

Turbomachines, such as gas turbine engines, are known. Typical turbomachines include a compression section having large rotors. During startup, the rotors must be accelerated to high rotational speeds until the rotors rotate fast enough to sustain operation of the turbomachine. A motor-generator may be used to accelerate the rotors. The motor-generator is rotatably coupled to the turbomachine through a connection shaft. Once the turbomachine is self-sustaining, the turbomachine rotatably drives the motor-generator, which generates power that is supplied to various components.

It is sometimes desirable to decouple the turbomachine from the motor-generator to ensure that errors or failure modes are not communicated between the turbomachine and the motor-generator. Accordingly, the connection shaft is movable to a position that is decoupled from the motor-generator. In the decoupled position, the connection shaft rotates relative to the motor-generator. As known, pressures inside the motor-generator can exert undesirable loads on the connection shaft when the connection shaft is disconnected from the motor-generator. The loads, and thermal energy levels resulting from the loads, can damage and degrade various components, such as the bearings that support the connection shaft or seals near the connection shaft.

SUMMARY

An example turbomachine connection shaft is configured to selectively rotatably couple a turbomachine rotor and a motor-generator. The connection shaft establishes a communication path that selectively vents the motor-generator.

An example motor-generator assembly includes a motor-generator and a connection shaft. The connection shaft is rotatably coupled to a rotor of a gas turbine and selectively rotatably coupled to the motor-generator. The connection shaft establishes a communication path configured to block fluid flow when the connection shaft is coupled to the motor-generator, and to vent the motor-generator when the connection shaft is decoupled from the motor-generator.

An example method of reducing loads on a connection shaft includes disengaging a connection shaft from a motor-generator such that the connection shaft is not rotatably coupled to the motor-generator. The method communicates a fluid away from the motor-generator through a communication path established within the connection shaft.

These and other features of the disclosed examples can be best understood from the following specification and drawings, the following of which is a brief description.

DETAILED DESCRIPTION

Figure 1:
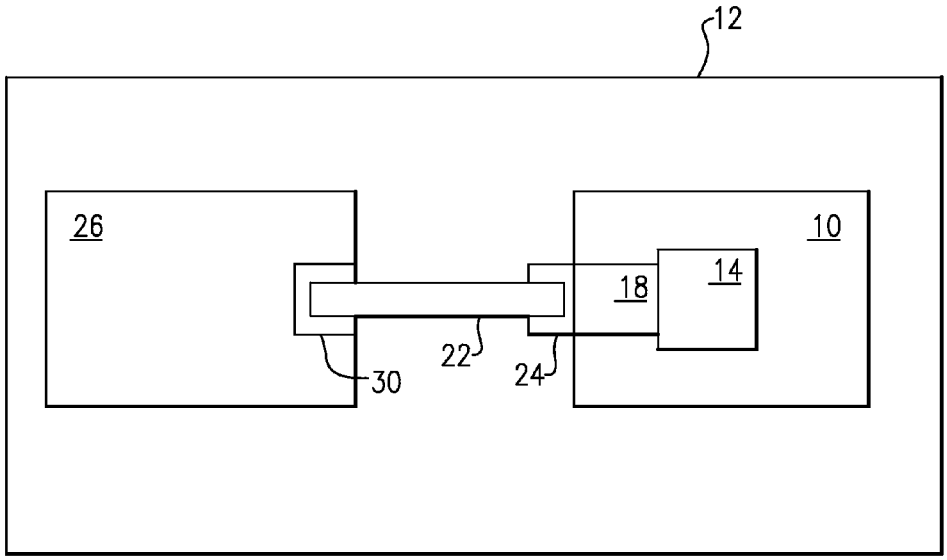
FIG. 1 shows highly schematic view of a motor-generator and a gas turbine engine selective coupling arrangement.

Referring to FIG. 1, a gas turbine engine 10 propels an aircraft 12. The gas turbine engine 10 is an example type of turbomachine.

The example engine 10 includes a compressor rotor 14 that is rotatably coupled to a gearbox 18. A connection shaft 22 is configured to rotate together with a gearbox shaft 24. The compressor rotor 14 rotates the gearbox shaft 24 through the gearbox 18 during some modes of operation. The gearbox shaft 24 rotates the compressor rotor 14 through the gearbox 18 during other modes of operation.

The example aircraft 12 further includes a motor-generator 26 having a journal shaft 30 that rotates together with the connection shaft 22. The journal shaft 30 disengages from the motor-generator 26 to decouple the connection shaft 22 from the motor-generator 26, which decouples the motor-generator 26 from the engine 10. Although described as a connection shaft, those skilled in the art and having the benefit of this disclosure will understand that other types of shafts and rotatable bodies are possible and fall within the scope of this disclosure.

The example motor-generator 26 is rotatably coupled to the engine 10 during startup of the engine 10. When rotatably coupled, the motor-generator 26 rotates the journal shaft 30 to rotate the connection shaft 22, which drives the gearbox 18 (through the gearbox shaft 24) to rotate the compressor rotor 14. The gearbox 18 is used to step-up or step-down the rotational speed of the connection shaft 22 as needed. In this example, the motor-generator 26 continues to rotatably drive the rotor 14 until the rotor 14 has reached a speed capable of compressing enough air to sustain operation of the engine 10.

In this example, the motor-generator 26 operates in a generator-mode after the engine 10 has reached a self-sustaining speed. In the generator-mode, the motor-generator 26 provides electrical power to other areas of the aircraft 12 through the aircraft's electrical system. Integrated drive generators and variable frequency generators are example types of the motor-generator 26.

The engine 10 drives the motor-generator 26 in the generator-mode. The gearbox 18 may be used to step-up or step-down the rotational speed of the connection shaft 22 as needed. The motor-generator 26 generates power in a known manner when operating as a generator.

Figure 2:
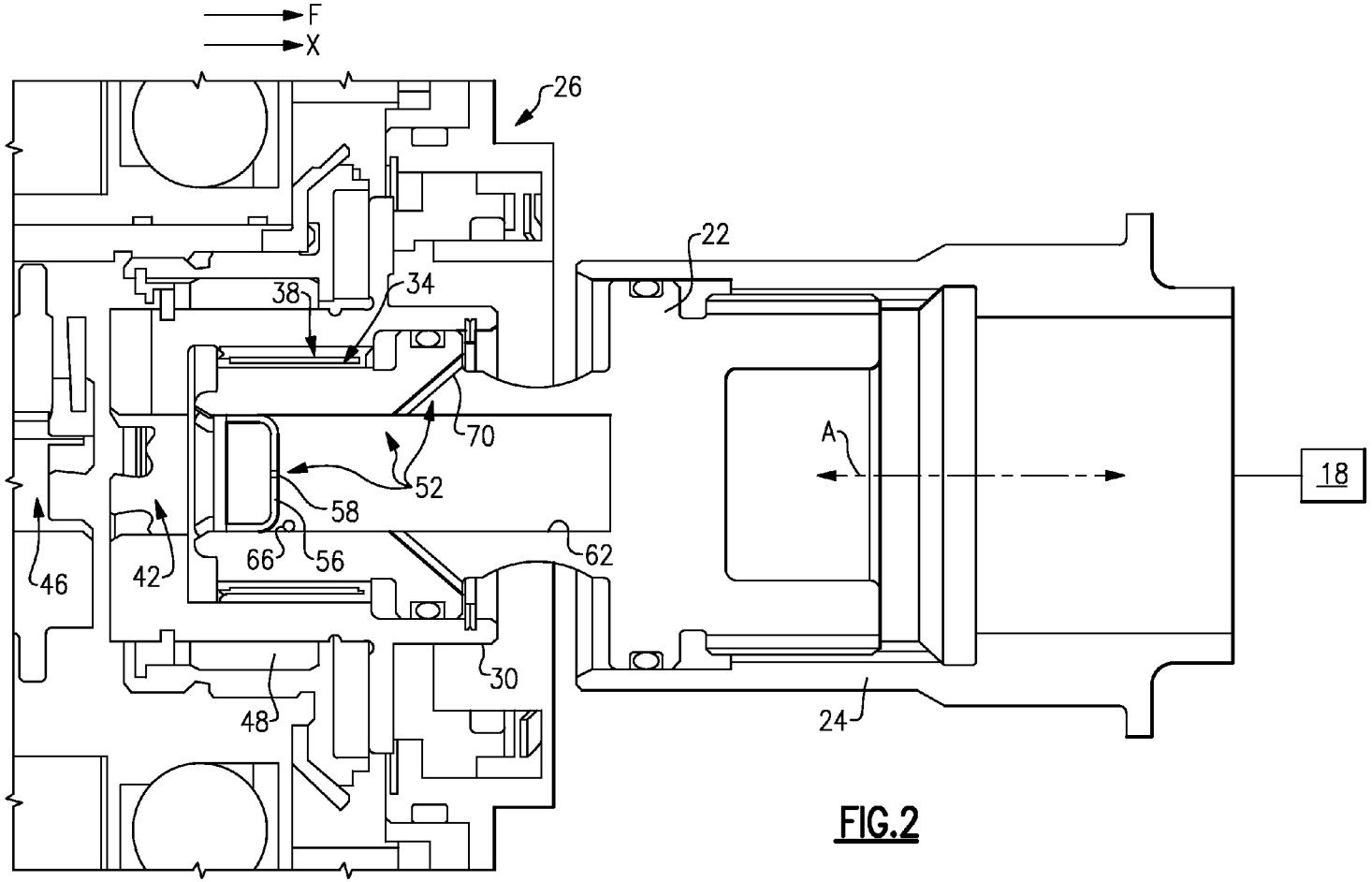
FIG. 2 shows a sectional view of an example connection shaft suitable for use in the FIG. 1 arrangement.

Referring to FIG. 2, the example connection shaft 22 includes splines 34 that mesh with splines 38 of the journal shaft 30. The splines 34 and 38 rotatably connect the journal shaft 30 and the connection shaft 22.

The example journal shaft 30 includes a journal jaw arrangement 42 that is configured to engage a motor-generator jaw arrangement 46 extending from the motor-generator 26. Engaging the journal jaw arrangement 42 with the motor-generator jaw arrangement 46 rotatably couples the connection shaft 22 (and the journal shaft 30) with the motor-generator 26.

The example connection shaft 22 is selectively moveable to a decoupled position, which is shown in FIG. 2. In the decoupled position, the journal jaw arrangement 42 is disengaged from the motor-generator jaw arrangement 46. Notably, the connection shaft 22 is not rotatably coupled to the motor-generator 26 when the connection shaft 22 is in the decoupled position. In the decoupled position, the connection shaft 22 and the journal shaft 30 rotate together relative to the motor-generator 26. For example, the connection shaft 22 and the journal shaft 30 are supported on radial support bearings 48. When the connection shaft 22 is decoupled from the motor-generator 26, the connection shaft 22 and the journal shaft 30 rotate relative to the radial support bearings 48.

In this example, pressure within the motor-generator 26 exerts an axial force F on the journal shaft 30 and the connection shaft 22. As can be appreciated, if the force F is greater than the pressure force reacting on shafts 22 and 30 from outside the motor-generator 26, the force F urges the journal shaft 30 and the connection shaft in the direction X. In the prior art, the force F is greater than the outside reaction forces on shafts 22 and 30 during some stages of flight, such as climb and cruise. In the prior art, the force F is less than the outside reaction forces on shafts 22 and 30 during other stages of flight, such as take-off and landing.

The example connection shaft 22 establishes a communication path 52 that reduces pressure within the motor-generator 26 by venting to ambient. Relieving the pressure by venting reduces the loads applied to the connection shaft 22 in the direction X. In some examples, the connection shaft 22 is biased toward the motor-generator 26 in a direction –X after pressure within the motor-generator 26 is relieved through the communication path 52. Biasing the connection shaft 22 toward the motor-generator 26 reduces frictional loading and thermal energy build-up.

In this example, an expansion plug 56 includes an aperture 58 that establishes a portion of the communication path 52. The plug 56 is press fit within a central bore 62 established within the connection shaft 22. The aperture 58 is configured to communicate fluid from a first axial side of the plug 56 to an opposing, second axial side of the plug 56. In this example, the aperture 58 is coaxial with a rotational axis A of the connection shaft 22.

When the connection shaft 22 is rotatably coupled to the motor-generator 26, the aperture 58 is plugged by a dollop of solder 66. Temperatures of the connection shaft 22 during coupled operation typically range between 200 degrees and 285 degrees Fahrenheit (93 degrees and 141 degrees Celsius), which are low enough temperatures to maintain the solder 66 in solid form.

When the connection shaft 22 is decoupled from the motor-generator 26, temperatures in the connection shaft 22 increase due to frictional loads, for example. Temperatures of about 400 degrees Fahrenheit (204 degrees Celsius) cause the solder 66 to melt, which allows fluid to communicate to ambient from the motor-generator 26 to the bore 62 along the communication path 52. Such temperatures are typical when the connection shaft 22 is decoupled from the motor-generator 26 and rotating relative to the motor-generator 26. In some examples, a significant rise in temperature can trigger the decoupling of the connection shaft 22 from the motor-generator 26. As can be appreciated, the example communication path 52 selectively vents fluid from the motor-generator 26 due to the solder 66.

Another portion of the communication path 52 is established by holes 70 extending from the bore 62 to an outer surface of the connection shaft 22. The holes 70 may be drilled in the connection shaft 22.

In this example, fluid moves from the motor-generator 26 through along the communication path 52, which extend from the aperture 58 into the bore 62 through the holes 70 to ambient. The communication path 52 reduces the pressures inside the connection shaft 22, which lessens the force F urging the connection shaft 22 in the direction X. The fluid is air in this example. The communication path 52 only vents the motor-generator 26 when the connection shaft 22 is decoupled from the motor-generator 26. The example solder 66 blocks fluid flow through the communication path 52 when the connection shaft 22 is coupled to the motor-generator 26 because the temperatures are not high enough to melt the solder 66.

In this example, the communication path 52 relieves pressures inside the motor-generator 26 so that the force F is less than the pressure force reacting on shafts 22 and 30 outside the motor-generator 26 during all stages of flight.

Figure 3:
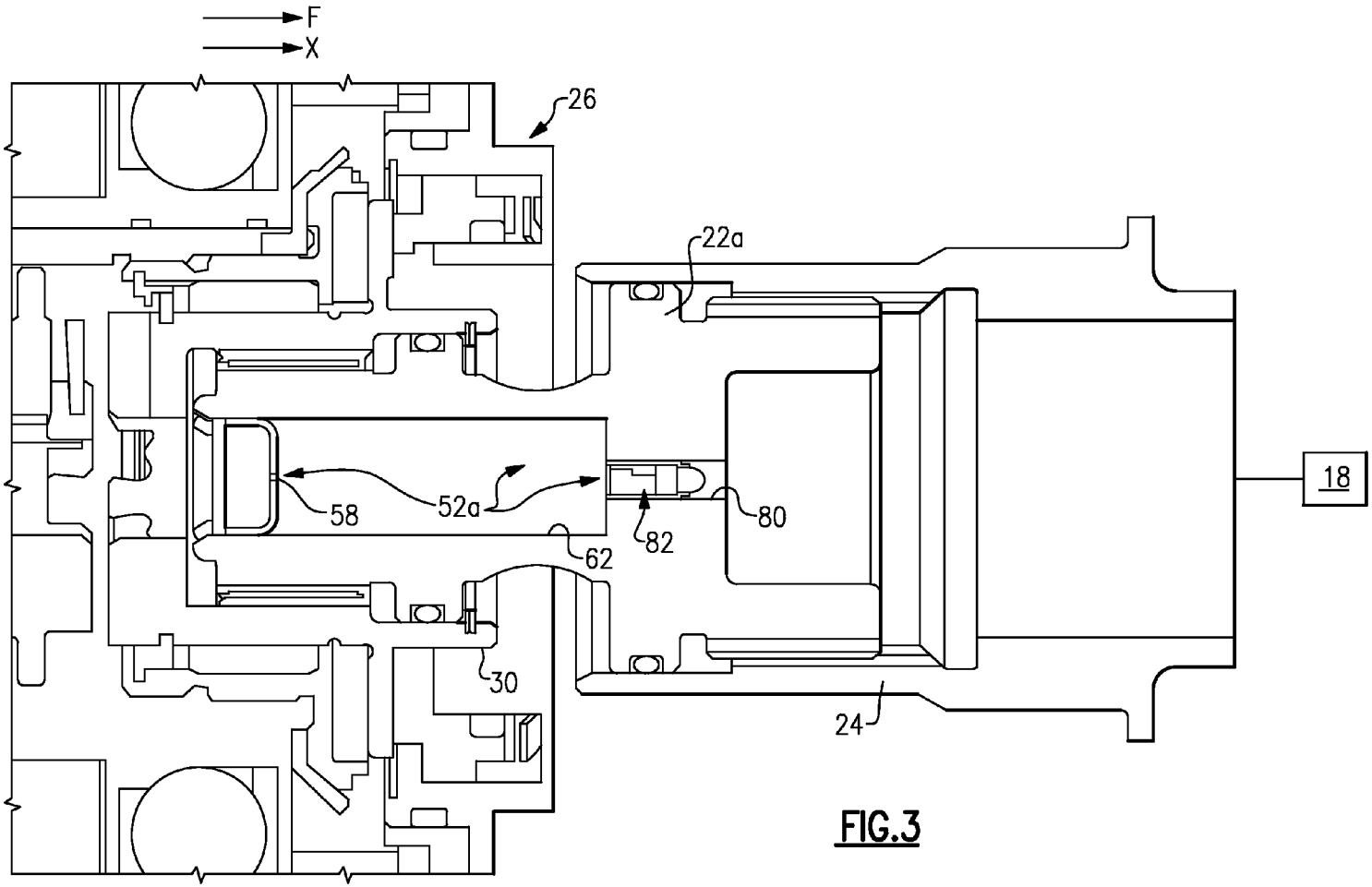
FIG. 3 shows a sectional view of another example connection shaft suitable for use in the FIG. 1 arrangement.

Referring now to FIG. 3, in another example, a communication path **52*a* within a connection shaft 22*a* includes the aperture 58, the bore 62, and a hole 80 that communicates the pressurized fluid from the bore 62 through the gearbox shaft 24 into the gearbox 18**.

In this example, a plug 82, such as a screened LEE® plug is positioned within the hole 80 to limit movement of debris between the motor-generator 26 and the gearbox 18. In this example, the pressure of the motor-generator 26 equalizes to the pressure within the gearbox 18 due to the vent, which lessens the force F urging the connection shaft 22 in the direction X.

Features of the disclosed examples include reducing internal pressures of the motor-generator to reduce the axial loading on a connection shaft. Another feature is biasing a connection shaft toward a motor-generator when the connection shaft is disconnected from the motor-generator. The connection shaft is biased toward the motor-generator at all stages of the flight envelope rather than alternating between a positive bias and a negative bias.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A turbomachine connection shaft assembly, comprising:

a connection shaft that is configured to selectively rotatably couple a turbomachine rotor and a motor-generator, the connection shaft establishing a communication path that selectively vents a fluid from the motor-generator, the communication path established within the connection shaft.

2. The turbomachine connection shaft assembly of claim 1, wherein the fluid moves from the communication path to a turbine engine having the turbomachine rotor.

3. The turbomachine connection shaft assembly of claim 1, wherein the fluid moves from the communication path to ambient.

4. The turbomachine connection shaft assembly of claim 1, further comprising:

an expansion plug disposed within an axially extending bore that is established within the connection shaft, the expansion plug defining an aperture that communicates the fluid from a first axial side of the expansion plug to an opposing, second axial side of the expansion plug.

5. The turbomachine connection shaft assembly of claim 4, wherein the aperture is coaxial with the connection shaft.

6. The turbomachine connection shaft assembly of claim 4, including a dollop of solder that moves from a first position when the connection shaft and the motor-generator are rotatably coupled to a second position when the connection shaft and the motor-generator are rotatably decoupled, the dollop of solder configured to restrict flow through the aperture in the first position and allow flow in the second position.

7. The turbomachine connection shaft assembly of claim 1, including a screened plug disposed within a portion of the communication path, wherein the communication path communicates the fluid to an engine.

8. The turbomachine connection shaft assembly of claim 1, wherein the connection shaft defines at least one hole extending from an axially extending bore to a radially outer surface of the connection shaft.

9. The turbomachine connection shaft assembly of claim 8, wherein the communication path comprises portions of the bore, an aperture, and the hole.

10. The turbomachine connection shaft assembly of claim 1, including a journal shaft that receives an end portion of the connection shaft, the connection shaft configured to rotate the journal shaft, wherein the journal shaft is configured to selectively rotatably couple the connection shaft to the motor-generator.

11. The turbomachine connection shaft assembly of claim 1, wherein the motor-generator is a variable frequency generator.

12. A motor-generator assembly, comprising:

a motor-generator; and a connection shaft rotatably coupled to a rotor of a gas turbine and selectively rotatably coupled to the motor-generator, wherein the connection shaft establishes a communication path configured to block fluid flow when the connection shaft is coupled to the motor-generator, and to vent the motor-generator when the connection shaft is decoupled from the motor-generator, the communication path established within the connection shaft.

13. The motor-generator assembly of claim 12, including a journal shaft received over one end of the connection shaft, the journal shaft configured to rotate together with the connection shaft.

14. The motor-generator assembly of claim 13, including a radial support bearing arrangement configured to support the connection shaft, wherein the connection shaft rotates with the radial support bearing arrangement when the connection shaft is coupled to the motor-generator, and the journal shaft rotates relative to the radial support bearing when the connection shaft is decoupled from the motor-generator.

15. A method of reducing loads on a connection shaft, comprising:

disengaging a connection shaft from a motor-generator such that the connection shaft is not rotatably coupled to the motor-generator; and communicating a fluid away from the motor-generator through a communication path established within the connection shaft.

16. The method of claim 15, wherein the disengaging comprises disengaging jaws of a journal shaft with corresponding jaws of the motor-generator.

17. The method of claim 15, wherein the method is performed on an aircraft and the connection shaft is biased axially toward the motor-generator during all stages of flight of the aircraft.

18. The motor-generator assembly of claim 12, including a screened plug disposed within a portion of the communication path.

19. The method of claim 15, including limiting movement of debris along the communication path using a screened plug.

20. The method of claim 15, including blocking the communication path when the connection shaft engages the motor-generator.

* * * * *